United States Patent [19]

Stoudt

[11] Patent Number: 4,579,286

[45] Date of Patent: Apr. 1, 1986

[54] MULTI-ORIFICE AIRLESS SPRAY NOZZLE

[75] Inventor: George W. Stoudt, Oberlin, Ohio

[73] Assignee: Nordson Corporation, Amherst, Ohio

[21] Appl. No.: 535,365

[22] Filed: Sep. 23, 1983

[51] Int. Cl.[4] ..... B05B 1/14

[52] U.S. Cl. ..... 239/568; 239/552

[58] Field of Search ..... 239/548, 552, 566, 568; 29/157 C

[56] References Cited

U.S. PATENT DOCUMENTS

| | | | |
|---|---|---|---|
| 3,196,527 | 7/1965 | Bete | 29/157 C |
| 3,521,824 | 7/1970 | Wilcox | 239/424.5 |
| 4,346,849 | 8/1982 | Rood | 239/597 |

*Primary Examiner*—Joseph F. Peters, Jr.
*Assistant Examiner*—Scott Malpede
*Attorney, Agent, or Firm*—Wood, Herron & Evans

[57] ABSTRACT

An airless spray coating nozzle having at least two orifices formed by the interpenetration of a plurality of grooves through a nozzle tip. The pressurized side or backside of the nozzle tip includes a single groove, and the unpressurized side of the tip includes two parallel grooves. Each parallel groove interpenetrates the backside groove, thereby forming orifices through the tip. The nozzle tip is used to spray a wide, flat spray pattern of coating material having an even distribution of coating material across the spray pattern even when the coating material is applied at a high flow rate.

9 Claims, 7 Drawing Figures

MULTI-ORIFICE AIRLESS SPRAY NOZZLE

BACKGROUND OF THE INVENTION

This invention generally relates to airless spray nozzles and more particularly to airless spray nozzle tips.

Further, this invention relates to a method of forming a flat, wide spray pattern of a liquid coating material sprayed at a high flow rate wherein the coating material is evenly distributed across the spray pattern.

Spray nozzles are used to shape and atomize liquids projected from a spray gun. Upon discharge from the spray nozzle, the liquid material breaks up into droplets and forms a spray pattern or cloud of droplets. Various spray patterns are used for different applications. A common spray pattern is the flat fan-shaped pattern.

Nozzles used to produce a flat fan pattern generally take one of two forms, either air or airless. In an airless spray nozzle, the small nozzle orifice, from which the high pressure liquid emerges, shapes the liquid into the fan pattern. The liquid is emitted from the nozzle as a flat sheet or film of material which is caused to break up into droplets by various physical forces acting on the sheet of liquid.

Generally, an airless spray nozzle includes a nozzle tip formed from a blank in which an orifice is cut. One particular airless spray nozzle used in forming a flat spray pattern of atomized liquid is described in Rood U.S. Pat. No. 4,346,849. As disclosed in this patent, an orifice through a nozzle tip is formed by the interpenetration of a first groove on the pressurized or backside of the nozzle tip with a second groove on the discharge side or front side of the nozzle tip. The nozzle tip formed in this fashion produces a predictable fan pattern where the fluid droplets are properly and evenly distributed across the fan pattern. The shape and depth of the interpenetrating grooves determines the spray pattern width and the flow rate of the nozzle tip.

The requirements of a spray pattern formed by an airless spray nozzle in the spray coating industry are stringent. Paint droplets generally must be evenly distributed across the width of the fan pattern. There should be no heavy deposits of coating material made at the extreme edges of the fan pattern. Heaviness at the extreme edges of the fan pattern is known as tailing.

Although nozzles made in accordance with only the disclosure in U.S. Pat. No. 4,346,846 are suitable for use in a wide variety of applications projecting various widths of fan patterns under a wide variety of conditions, but those nozzles are unsuitable for use in producing a a wide spray pattern at an extremely high flow rate. Under these conditions, nozzles made in accordance with the teaching of U.S. Pat. No. 4,346,849 produce relatively heavy tailing.

For purposes of the present invention, a wide spray pattern refers to a pattern which is at least about 26" wide, 10" from the nozzle tip. The spray pattern width, for purposes of the present invention, is defined as the pattern width measured 10" from the nozzle tip when a baked enamel having a viscosity of 21 seconds using a Zahn No. 2 cup at 105° F. is sprayed through the nozzle at about 500 psi and a temperature of about 170° F. The spray pattern width actually formed will vary depending upon the material sprayed and the spray conditions. A high flow rate is generally at least about 0.30 gallons per minute (gpm). Flow rate is defined as the amount of water which will pass through an orifice at 500 psi.

Accordingly, it is an object of the present invention to disclose a spray nozzle which can produce an extremely wide, flat, evenly distributed spray pattern of coating material at a high flow rate. Further, it is an object of the present invention to disclose such a nozzle which is easy to manufacture on a repetitive basis and which provides predictable results.

Further, it is an object of the present invention to provide a method of forming an extremely wide, flat, evenly distributed spray pattern of coating material at a high flow rate.

These, as well as other objects and advantages, can be obtained by using a nozzle which has a nozzle tip having at least two orifices. The orifices are created by the interpenetration of multiple grooves on a single nozzle tip. More specifically, a first groove extends from the back or pressurized side of the nozzle tip. A second and a third groove extend through the front or unpressurized side of the nozzle tip. Each front side groove interpenetrates the backside groove to create orifices. The orifices are provided to form a wide spray pattern. The size of each orifice provides a fraction of the desired flow rate and the combined flow rate of the orifices provides the desired high flow rate.

Other objects and advantages of the present invention will be further understood through the following detailed description and drawings in which.

DETAILED DESCRIPTION

Figure 1:
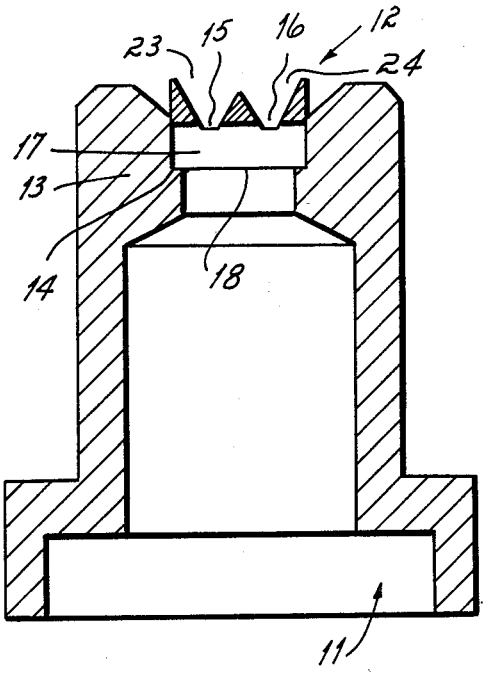
FIG. 1 is a vertical cross section of a nozzle for use in the present invention.

As shown in FIG. 1, there is a nozzle 11 which supports a nozzle tip 12 in a nozzle body 13. The nozzle tip 12 is brazed to the nozzle body at an annular seat 14. In use, the nozzle body would be connected to a source of pressurized coating material such as a spray gun (not shown). Orifices in the nozzle tip shape the spray pattern of coating material directed from the spray gun. This nozzle tip 12 is a cylindrical disc, preferably a sintered tungsten carbide cylindrical disc having a diameter of, for example, about 0.11" and a depth of, for example, about 0.075".

A first orifice 15 and a second orifice 16 extend through the nozzle tip 12. These orifices are formed by a plurality of interpenetrating grooves. A first or backside groove 17 extends inwardly from a pressurized or backside 18 of nozzle tip 12. This groove includes two sidewalls 19 and 21 which join together at a substantially straight bottom edge 22. Backside groove 17 preferably extends approximately halfway through the tip 12.

Figure 2:
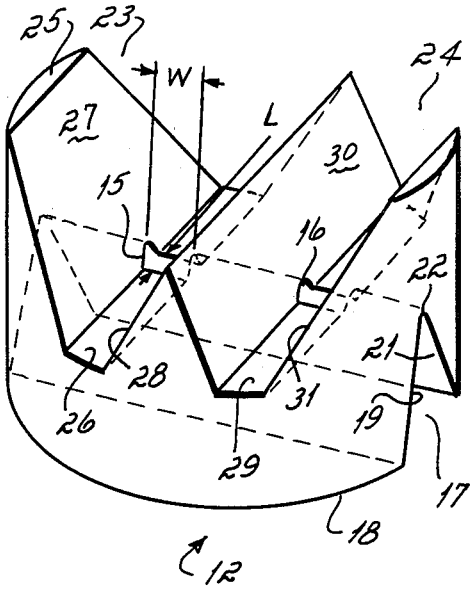
FIG. 2 is a perspective view of the novel nozzle tip made according to the present invention.

A first and a second front side groove 23 and 24, respectively, extend through the tip 12 from the front or unpressurized side 25 of nozzle tip 12. The perpendicular cross sections of front side grooves 23 and 24 generally have the shape of isoceles trapezoids. As such, front side groove 23 includes a bottom or base 26 and two sidewalls 27 and 28, and likewise front side groove 24 includes a bottom or base 29 and sidewalls 30 and 31. These side walls extend upwardly and outwardly from their respective bases. The front side grooves 23 and 24 are perpendicular to the backside groove, and parallel to each other. As shown in FIG. 2, to the extent that the bases 26 and 29 of the front side grooves 23 and 24 extend below the bottom edge 22 of backside groove 17, orifices 15, 16 are created.

Figure 3:
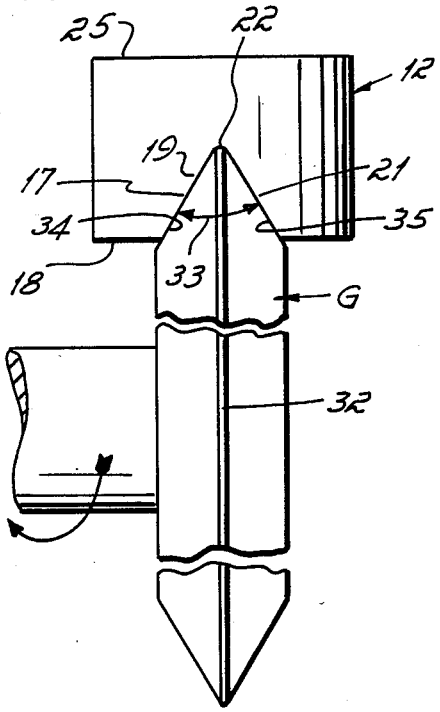
FIG. 3 is a diagrammatic view of a grinding wheel cutting a groove into a nozzle tip blank.
Figure 4:
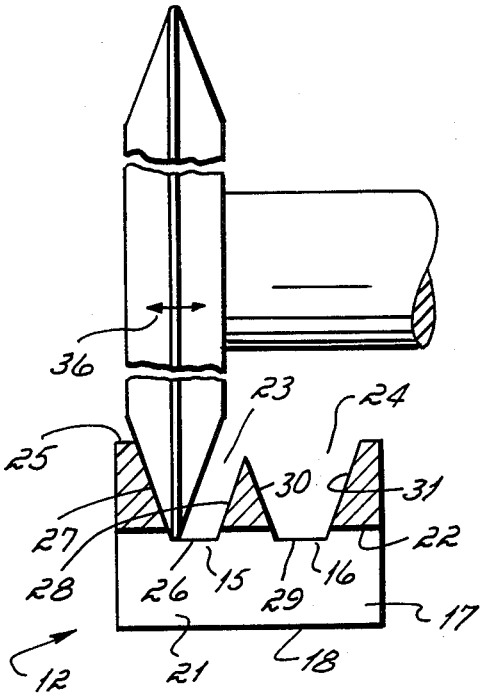
FIG. 4 is a diagrammatic view of a grinding wheel cutting a trapezoidal groove into a nozzle tip blank.

As shown in FIGS. 3 and 4, each of the grooves is formed by a grinding wheel G having a wedge-shaped or frusto-conical cutting edge 32. The included angle 33 of the cutting edge 32 determines the slope of the side walls of the respective grooves. The method of forming these grooves is disclosed more fully in Rood U.S. Pat. No. 4,346,849, the disclosure of which is incorporated herein by reference.

The orifices through the nozzle tips are defined by the included angle 33 of the grinding wheel G used to form each groove, the length (L) and width (W) of the formed orifices and the chordal distance between the two walls of a groove at a given distance from the bottom edge or base of the groove. As shown in FIG. 3, the backside groove 17 is cut through the flat backside 18 by grinding wheel G. When the grinding wheel G is cutting through the disc, it is generally held perpendicular to the plane of tip 12. The walls 19 and 21 of backside groove 17 have the same slope as the cutting surfaces 34 and 35 of grinding wheel G. Thus, the included angle 33 of the grinding wheel G used to cut a groove defines the slope of the walls of that groove.

The front side grooves 23 and 24 are started in substantially the same manner as the backside groove 17 although a grinding wheel having a different included angle may be used. The grinding wheel G first forms a wedge-shaped groove through front side 25 of the nozzle tip. The bases 26 and 29 of grooves 23 and 24 are formed by moving the grinding wheel G laterally relative to tip 12 as indicated by arrow 36 (shown only with respect to groove 23). By moving the grinding wheel G laterally, the chordal distance from side wall 27 to side wall 28 is increased. This is called side feeding.

The lengths of the orifices are measured along the bases 26 and 29 in a direction perpendicular to the backside groove 17. Therefore, the length is increased by increasing the depth of penetration of the respective grooves. The width is measured from side wall to side wall of a front side groove at the widest portion of the orifices, i.e., along the bottom edge 22 of the backside groove 17.

The nozzle tip of the present invention is designed to provide a wide spray of material at a high flow rate. The flow rate of a nozzle is increased by increasing the size of the orifices through the nozzle. The width of the spray pattern, however, is a function of flow rate, orifice length, and the angle of the backside groove 17, i.e., the angle 33 of the grinding wheel G. Increasing pressure, increasing orifice length, and decreasing angle 33 of the grinding wheel used to form the backside groove all tend to increase spray pattern width.

To form a nozzle tip according to the present invention, the included angle of the grinding wheel used to cut the backside groove should be from about 20° to about 25°, and the included angle of the grinding wheel used to form the front side groove can be from about 25° to about 60°. Further, the orifices should have a length from about 0.010′ to about 0.015″, and a width from about 0.015″ to about 0.030″.

The nozzle of the present invention is useful to obtain a wide spray pattern at a high flow rate where the spray pattern is evenly distributed across the spray pattern. The spray patterns formed by the orifices are fan-shaped patterns which overlap each other and are aligned with each other along the long axis of each spray pattern. Accordingly, the orifices combine to form one wide fan-shaped spray pattern.

Figure 5:
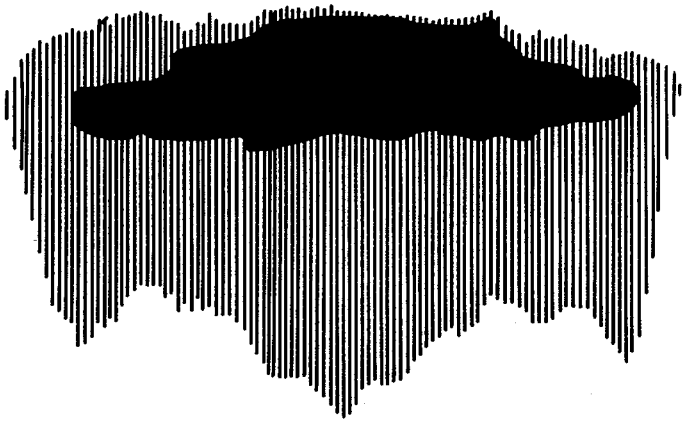
FIG. 5 is a wide spray pattern obtained using a prior art nozzle tip at a low flow rate.

Using a cross-cut nozzle made according to the disclosure in Rood U.S. Pat. No. 4,346,849, one can obtain a wide spray pattern which is evenly distributed at a relatively low flow rate. FIG. 5 is a spray pattern obtained using such a cross-cut nozzle. The spray patterns discussed hereinafter are formed by spraying a short burst of coating material against an upright vertical sheet of corrugated paper with the long axis of the spray at a horizontal. Corrugated paper is used for this purpose because it eliminates wash-out or distortion of the true spray pattern caused by the blast from the spray nozzle. The coating material strikes the sheet of corrugated paper and runs down the sheet along the grooves in the paper. Therefore, the quantity of coating material sprayed on any particular areas is reflected by the length of the rivulet in the groove running vertically downward beneath the spray. All of the spray patterns were obtained spraying an enamel having a viscosity of 21 seconds using a Zahn No. 2 cup at a temperature of 105° F. The enamel was sprayed at 170° F. ±10° and at a pressure of about 500–600 psi. The black lines represent the enamel.

FIG. 5 depicts an evenly distributed, wide spray pattern obtained from a nozzle tip having only one orifice. The backside groove of this nozzle was formed from a grinding disc having an included angle of 20°. The width of the groove was measured at 0.001″ above the bottom edge of the groove. A front side groove was formed with a grinding wheel having a 40° included angle. The formed groove was 0.0028″ wide at 0.001″ above the base of the groove. This width was increased 0.010″ by side feeding. The width of the formed orifice was 0.0193″, and the length was 0.013″. The flow rate through the orifice was 0.20 gallons per minute and the pattern width is 28″ at 10″ from the orifice. This spray pattern shows a good even distribution which is acceptable for most applications requiring a wide spray pattern at a low flow rate.

Figure 6:
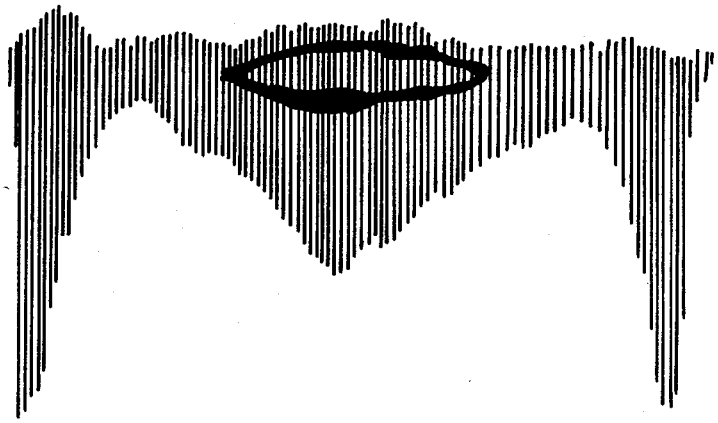
FIG. 6 is a spray pattern obtained using a prior art nozzle tip at high flow rate.

FIG. 6 is the spray pattern obtained from a nozzle having one orifice. The backside groove was cut by a grinding wheel having an included angle of 20°. The width of the formed backside groove was 0.014″ at 0.001″ from the bottom edge of the groove. The front side groove was cut by a grinding wheel having an included angle of 60°. The width of the front side groove was 0.0035″ measured at 0.001″ from its base. This was increased 0.002″ by side feeding. The formed orifice was 0.0285″ wide and 0.0215″ long and had a flow rate of 0.45 gallons per minute. The spray pattern from this nozzle was 28″ wide at 10″ from the orifice. The spray pattern shows extreme tailing at the sides. Such a distribution is unsuitable for most applications in the coating industry.

Figure 7:
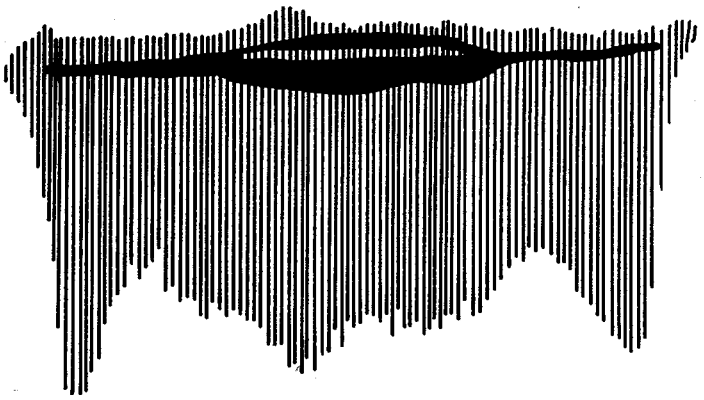
FIG. 7 is a spray pattern obtained using a nozzle tip according to the present invention at a high flow rate.

FIG. 7 shows a spray pattern formed using a dual opening nozzle tip in accordance with the present invention. A backside groove was formed with a cutting wheel having a 20° included angle. The width of this groove was 0.009″ at 0.001″ from the bottom edge of the groove. Two front side grooves were each cut with a grinding wheel having a 60° included angle. The first front side groove was 0.0045" wide measured at 0.001" from the base of the groove. This was increased 0.004" by side feeding. The orifice formed by the interpenetration of the backside groove and this front side groove was 0.0222" wide and 0.0132" long. The second front side groove was also 0.0045" wide at 0.001" from the base. This was also increased 0.004" by side feeding. The orifice formed by the interpenetration of this orifice with the backside groove measured 0.0227" wide and 0.0134" long. The flow rate of this nozzle was about 0.45 gpm, and the spray pattern was 27". As shown in FIG. 7, the distribution is comparable to that shown in FIG. 5 and drastically better than the spray pattern shown in FIG. 6.

A nozzle tip formed in accordance with the present invention is designed to produce a wide spray pattern of coating material at a high flow rate without extreme tailing. The orifices act together to form a wide, flat fan-shaped pattern, and the combined flow rates of the orifices in the nozzle tip exceeds 0.30 gpm. Further, a spray pattern formed by this multi-orificed nozzle tip does not have substantial tailing.

The preceding was a description of the preferred embodiment of the present invention. Further modification of the present invention can be made such as, for example, by increasing the number of grooves in the nozzle tip, thereby increasing the number of orifices. Persons skilled in the art to which this invention pertains will readily appreciate that minor changes can be made in the present invention.

However, I intend to be limited only by the scope of the following claims in which I claim:

1. A spray nozzle comprising means to provide a wide flat fan pattern at a high flow rate;

said means including a nozzle tip;

said tip having a first and second orifice;

a first groove on a first side of said tip; and a second and third groove on a second side of said tip wherein said second and third grooves each have trapezoidal cross sections and each being parallel to each other and perpendicular to said first groove, and each interpenetrate said first groove, thereby defining said first and second orifices.

2. The spray nozzle claimed in claim 1 wherein said first groove is a wedge-shaped groove.

3. The spray nozzle claimed in claim 1 wherein the flow rate through said nozzle of water at a pressure of 500 psi is at least about 0.30 gallons per minute.

4. The spray nozzle claimed in claim 3 wherein said tip produces a flat spray pattern of liquid when the nozzle is connected to a source of fluid under pressure, said pattern having a width of at least about 26 inches at 10 inches from said tip.

5. A spray nozzle comprising means to provide a wide flat fan pattern at a high flow rate;

said means including a nozzle tip;

said tip having at least two orifices;

at least one groove on a first side of said tip; and at least two grooves on a second side of said tip, said grooves on said second side each having a trapezoidal cross section and each being perpendicular to said groove on said first side and wherein said grooves on said second side each interpenetrate each groove on said first side, thereby defining said orifices.

6. The spray nozzle claimed in claim 5 wherein said groove on said first side is a wedge shaped groove having a substantially straight bottom edge and two sidewalls.

7. The spray nozzle claimed in claim 5 wherein the flow rate through said nozzle of water at a pressure of 500 psi is at least about 0.30 gallons per minute.

8. The spray nozzle claimed in claim 7 wherein said tip produces a flat spray pattern of liquid when the nozzle is connected to a source of liquid under pressure, said pattern having a width of at least about 26 inches at 10 inches from said tip.

9. A spray nozzle comprising means to provide a wide flat fan pattern at a high flow rate;

said means including a nozzle tip;

said tip having a first and second orifice;

a first linear groove extending completely across a first side of said tip;

a second and third linear groove on a second side of said tip wherein said second and third grooves are parallel to each other and perpendicular to said first groove and each interpenetrate said first groove, thereby defining said first and second orifices.

* * * * *